US011952796B1

(12) United States Patent
Korbel et al.

(10) Patent No.: US 11,952,796 B1
(45) Date of Patent: Apr. 9, 2024

(54) WIDTH-ADJUSTABLE DROP-IN STAIR SYSTEM FOR IN-GROUND VINYL LINER SWIMMING POOLS

(71) Applicant: International Swimming Pools, Inc., New Brunswick, NJ (US)

(72) Inventors: Bradley D. Korbel, Califon, NJ (US); David Miguelez, Langhorne, PA (US); Julio Reyes, Plainfield, NJ (US)

(73) Assignee: International Swimming Pools, Inc., News Brunswick, NJ (US)

( * ) Notice: Subject to any disclaimer, the term of this patent is extended or adjusted under 35 U.S.C. 154(b) by 0 days.

(21) Appl. No.: 18/051,093

(22) Filed: Oct. 31, 2022

(51) Int. Cl.
*E04H 4/14* (2006.01)

(52) U.S. Cl.
CPC ..... *E04H 4/144* (2013.01)

(58) Field of Classification Search
CPC ..... E04H 4/144
USPC ..... 4/496
See application file for complete search history.

(56) References Cited

U.S. PATENT DOCUMENTS 3,236,012 A 2/1966 Laven
3,374,491 A * 3/1968 Patin ..... E04H 4/144 52/249
3,478,370 A * 11/1969 Purpuri ..... E04H 4/144 52/188
3,593,348 A 7/1971 Toerge
3,789,435 A 2/1974 Heisner
9,145,698 B2 9/2015 Korbel
10,640,947 B1 5/2020 Jackson et al.
2013/0007956 A1* 1/2013 Korbel ..... E04H 4/144 4/506
2014/0123590 A1* 5/2014 Maiuccoro ..... E04H 4/0075 52/741.2
2018/0038125 A1* 2/2018 Desjoyaux ..... E04B 2/8629

FOREIGN PATENT DOCUMENTS

AU 591490 B2 11/1986

OTHER PUBLICATIONS

Latham Pool Products, Inc., "Vinyl Over Steel Steps", Jan. 2015, 2 pages.

* cited by examiner

*Primary Examiner* — Huyen D Le
(74) *Attorney, Agent, or Firm* — Walter W. Duft

(57) ABSTRACT

A width-adjustable drop-in stair system for an in-ground vinyl liner swimming pool includes a first and second drop-in step components having first and second lengths. The first and second drop-in step components are arranged as parts of a stair step that attaches to opposing sidewall panels of the swimming pool. The second drop-in step component is engaged in nested relationship with the first drop-in step component at a nesting overlap distance that is established to configure the stair step with a defined width dimension corresponding to a distance between the opposing sidewall panels to which the stair step is attached. The defined width dimension is less than the first and second lengths in total. The first and second drop-in step components are fastened together so as to be statically secured as parts of the stair step.

21 Claims, 10 Drawing Sheets

WIDTH-ADJUSTABLE DROP-IN STAIR SYSTEM FOR IN-GROUND VINYL LINER SWIMMING POOLS

BACKGROUND

1. Field

The present disclosure relates to vinyl liner swimming pool installations wherein a flexible water-tight liner is supported by rigid substructure components. More particularly, the disclosure concerns a drop-in stair system for in-ground vinyl liner swimming pools.

2. Description of the Prior Art

By way of background, in-ground vinyl liner swimming pools are conventionally constructed with a flexible water-tight liner supported within an excavation whose shape provides a desired perimeter configuration and depth contour of the swimming pool. The bottom of the excavation includes a base typically made of a sand/cement/vermiculite mixture. The sides of the excavation are lined with a rigid sidewall constructed from panels typically made of steel or a structural polymer that fasten together. A stair system having several steps is typically provided at the shallow end of the pool to facilitate ingress and egress. A bench or a ledge, which may be thought of as a type of stair system having a single step, can be provided at one or more other areas of the pool. In each such stair system implementation, the stair(s) may be constructed as a vinyl-covered system in which a set of one or more drop-in steps (made from the same rigid material as the sidewall) is covered by a correspondingly-shaped portion of the pool liner. In some vinyl-covered stair systems, the drop-in steps include both riser and tread components. In other vinyl-covered stair systems, the drop-in steps include only riser components that serve as forms that are back-filled with gravel and surfaced with a cap made of a sand/cement/vermiculite mixture to define the stair treads. This is known as an open-pour stair system.

The prevailing practice for the manufacturer of drop-in steps for vinyl-covered stair systems is to fabricate standard-length step sections that can be fastened together at the job site to provide a standard step width. The conventional technique requires precise measurements to ensure a proper fit, but this can be complicated by issues such as bowed walls and non-intended angular irregularities that result in non-calculated results. Such issues often arise when a stair system needs to be installed during the renovation of an existing pool system.

SUMMARY

Disclosed herein are embodiments of a width-adjustable drop-in stair system for an in-ground vinyl liner swimming pool. The stair system includes first and second drop-in step components having first and second lengths. The first and second drop-in step components are arranged as parts of a stair step that attaches to opposing sidewall panels of the swimming pool. The second drop-in step component is engaged in nested relationship with the first drop-in step component at a nesting overlap distance that is established to configure the stair step with a defined width dimension corresponding to a distance between the opposing sidewall panels at the locations where the stair step is attached. The defined width dimension is less than the first and second lengths of drop-in step components in total. The first and second drop-in step components are fastened together so as to be statically secured as parts of the stair step.

Also disclosed herein are a width-adjustable drop-in stair system kit, and a related installation method.

BRIEF DESCRIPTION OF THE DRAWINGS

The foregoing and other features and advantages will be apparent from the following more particular description of example embodiments, as illustrated in the accompanying Drawings.

DETAILED DESCRIPTION OF EXAMPLE EMBODIMENTS

Figure 1:
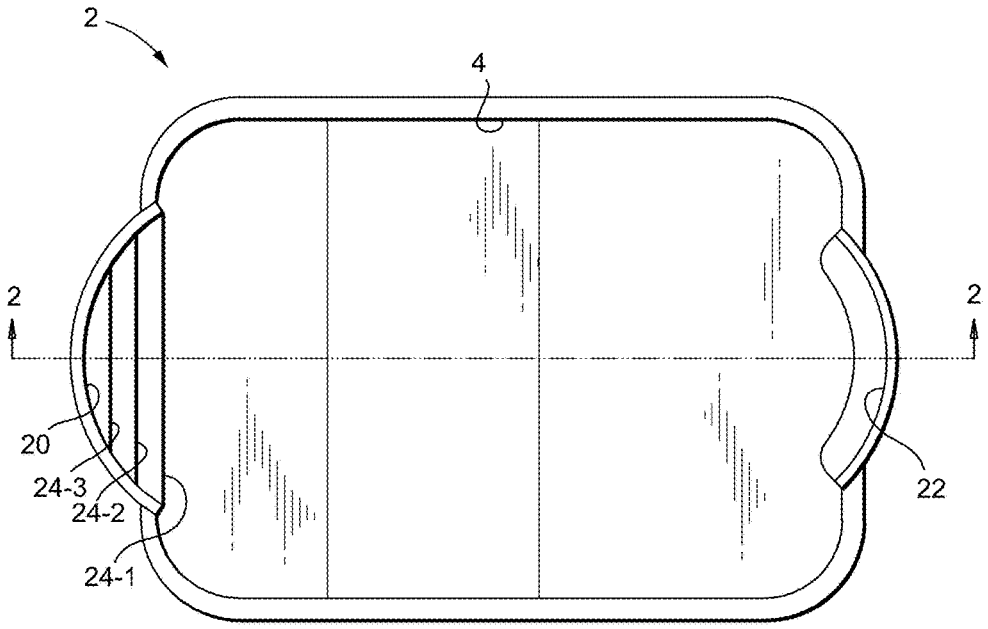
FIG. 1 is a plan view showing an in-ground vinyl swimming pool having a stair system at one end thereof.
Figure 2:
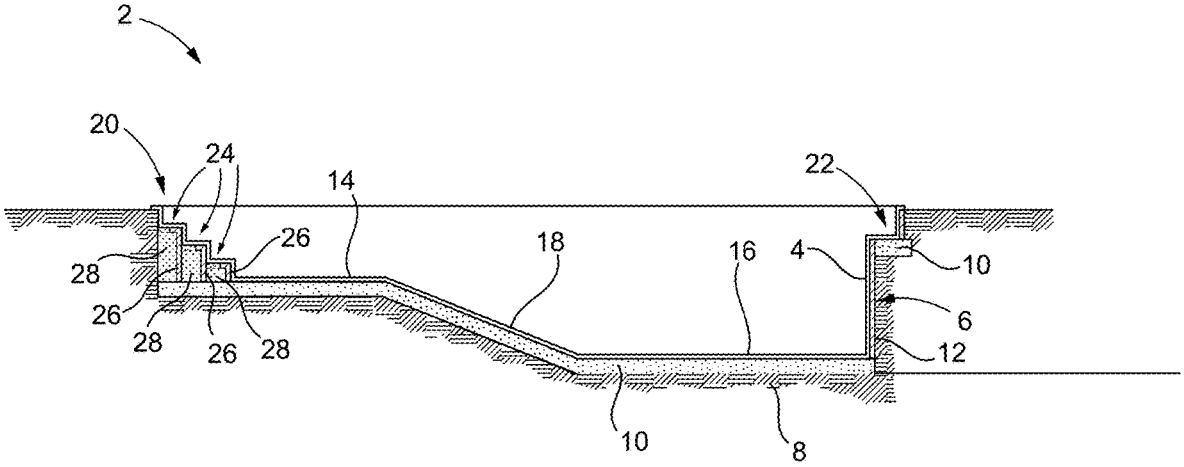
FIG. 2 is a cross-sectional view taken along line 2-2 in FIG. 1.

Turning now to FIGS. 1 and 2, a vinyl in-ground swimming pool 2 is shown for the purpose of illustrating a representative example environment in which the width-adjustable drop-in stair system disclosed herein may be installed. The swimming pool 2 has a flexible water-tight liner 4 that can be made from heavy duty vinyl or other suitable material. As can be seen in FIG. 2, the liner 4 is supported within a below-grade excavation 6 formed in the ground 8. The bottom of the excavation 6 is covered with a base 10 that may be formed from a sand/cement/vermiculite mixture or other suitable material that is capable of supporting the bottom of the liner 4 and the weight of the water above. The sides of the excavation are lined with a rigid sidewall 12. The sidewall 12 may be constructed in various ways. For example, sidewall panels made of zinc-coated steel or a structural polymer may be used. Although not shown, the upper peripheral edge of the liner 4 comprises a bead that is secured in a liner bead-receiver track at the top of the side wall.

The liner 4 is shaped to correspond to the swimming pool's perimeter configuration and depth contour. In the embodiment of FIGS. 1-2, the swimming pool's perimeter configuration is generally rectangular and its depth contour is such as to provide a shallow end 14, a deep end 16, and a sloping transition region 18. The liner 4 is also shaped to accommodate a stair system 20 installed at the shallow end 14 and an optional bench system 22 installed at the deep end 16. The stair system 20 includes has several stair steps 24 (e.g., steps 24-1, 24-2 and 24-3) formed by drop-in step components 26 that may be fabricated from the same material as the panels that form the sidewall 12. In the illustrated embodiment, the drop-in step components 26 form the stair risers. The drop-in step components 26 rests on the base 10, but have different heights to define the several stair steps. The stair treads are formed by back-filling the spaces 28 between the risers with a suitable filler material, such as gravel, that is surfaced with a cap made that can be made of the same sand/cement/vermiculite mixture used to form the base 10. The stair system 20 shown in FIGS. 1-2 thus exemplifies an open-pour vinyl-covered stair system. In alternative embodiments, stair systems with drop-in step components that include both treads and risers (e.g., made from zinc-coated steel or a structural polymer could be utilized. Although not shown, the bench system 22 may be formed in the same manner (i.e., with either a riser or a tread/riser combination), such that it may be thought of as a type of stair system, albeit one with a single step.

Although not shown, a ledge system may also be provided, either in lieu of or in addition to the bench system 22. Although benches and ledges for in-ground pools both consist of a single step, they serve different purposes. Benches are typically shallower and allow swimmers to sit partially submerged in the water. Ledges provide a larger area. The ledge area can be used by swimmers to recline partially submerged in the water, or for placing pool furniture, or for pets to play on, or for other recreational purposes. Ledges may also be thought of as a type of stair system.

As used herein, the term "stair system" includes underwater stairs, benches, ledges, and any other step structure that provides at least one submerged tread/riser combination. The term "stair system" also includes combinations structures, such as a combined stair/ledge arrangement in which one of the stair steps 24 (e.g., the top step) or several of the stair steps (e.g, the top step and the next lower step) are widened into a ledge by moving the drop-in step components 26 that define those steps further outwardly from the side of the pool.

Figure 3:
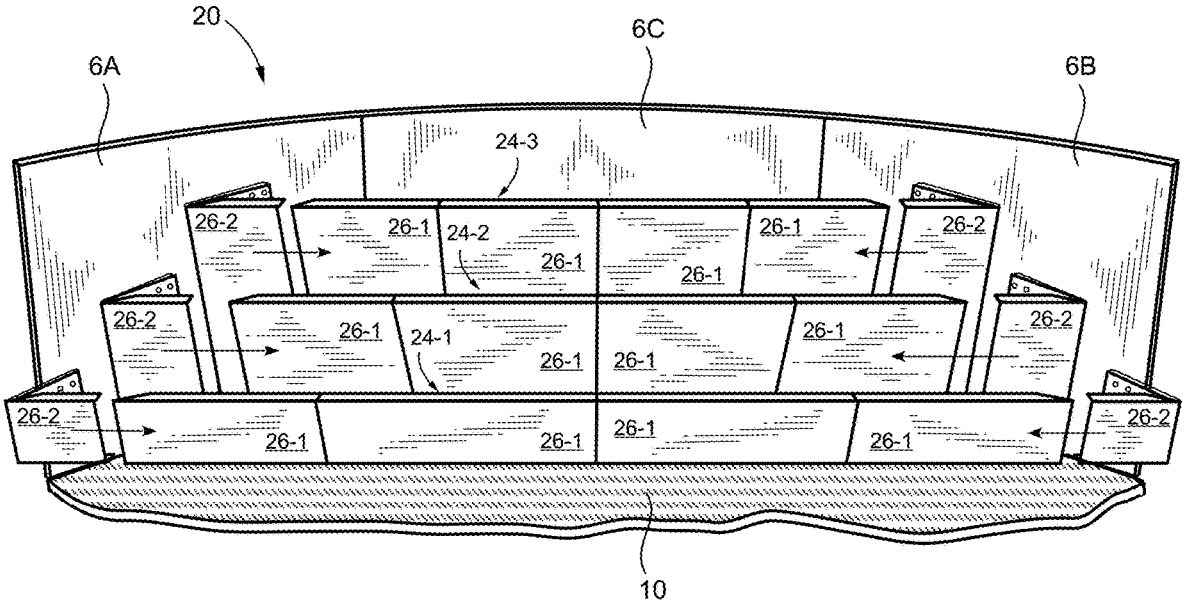
FIG. 3 is a exploded perspective view showing drop-in step components that may be used to form the stair system FIG. 1.
Figure 4:
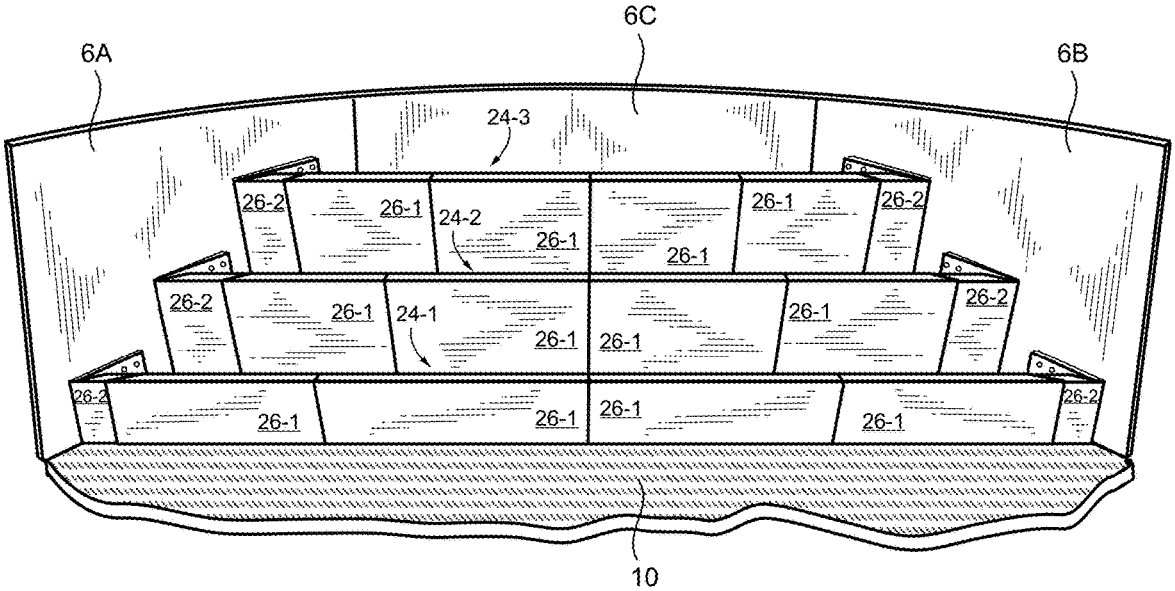
FIG. 4 is a perspective view showing the drop-in step components of FIG. 3 following attachment together as parts of the stair system of FIG. 1.

Turning now to FIGS. 3-4, an example construction is shown in which the individual stair steps 24 of the stair system 20 are installed and attached to opposing left and right sidewall panels 6A and 6B of the pool 2 in a manner that advantageously provides width-adjustment capability. By way of example only, the illustrated embodiment depicts three stair steps 24, namely, a bottom stair step 24-1, a middle stair step 24-2 and a top stair 24-3. The left and right sidewalls panels 6A and 6B to which the stair steps 24 are attached may be separated by one or more intermediate sidewall panels 6C according to the size and configuration of the pool 2. Alternatively, the left and right sidewall panels 6A and 6B might attach directly to each other.

Each stair step 24 may be constructed from an arrangement of one or more first drop-in step components 26-1 and one or more second drop-in step components 26-2. The number of first and second drop-in step components 26-1, 26-2 in each stair step 24 may vary according to the length of the individual drop-in step components, the size of the stair system 20, and the shape of the pool 2 in which the stair system is installed. For purposes of illustration only, each stair step 24 in FIGS. 3-4 is depicted as having at least two drop-in step components 26-1 (four in particular) and two second drop-in step components 26-2. Within each stair step 24, the first drop-in step components 26-1 are arranged to provide an interior portion of the stair step, and the two second drop-in step components 26-2 are arranged to provide the left and right side portions of the stair step. As will be described in more detail below, other arrangements of first and second drop-in step components 26-1, 26-2 may also be used.

If desired, the stair system 20 may be provided as a kit that includes some or all of the first and second drop-in step components 26-1 and 26-2 needed to construct each stair step. The kit can be made available to pool installers who may acquire the kit and use its components to fabricate and install the stair system 20 using the methodology now to be described.

The first drop-in step component 26-1 may have a characteristic first length and the second drop-in step component 26-2 may have a characteristic second length that may be the same as or different than the first length. By way of example only, the first drop-in step component 26-1 may have a standardized length that can be produced in several sizes, such as two feet, four feet, six feet, etc. The second drop-in step component 26-2 may likewise have a standardized length, but typically only needs to be produced in a single size that is may be less than the length of the first drop-in step component 26-1, such as six inches, twelve inches, sixteen inches, etc. As explained below, this is due to the fact that the first drop-in step components 26-1 serve as principal stair step members designed to provide a major portion of each stair step 24, whereas the second drop-in step components 26-2 are secondary adjustment members designed for custom-fitting the stair step between the left and right sidewalls panels 6A and 6B.

Each second drop-in step component 26-2 is engaged in nested relationship with a neighboring first drop-in step component 26-1, and is slidably adjustable therewith to establish a desired amount of nesting overlap distance. During installation of the stair system 20, an appropriate amount of nesting overlap in each stair step 24 is established so as to configure the stair step with a defined width dimension that corresponds to a distance between the opposing sidewall panels 6A and 6B at the precise locations where the stair step is attached. Due to the nesting overlap between the first and second drop-in step components 26-1, 26-2, the defined width dimension of each stair step 24 will be less than the combined first and second lengths of the first and second drop-in step components in total.

Figure 7:
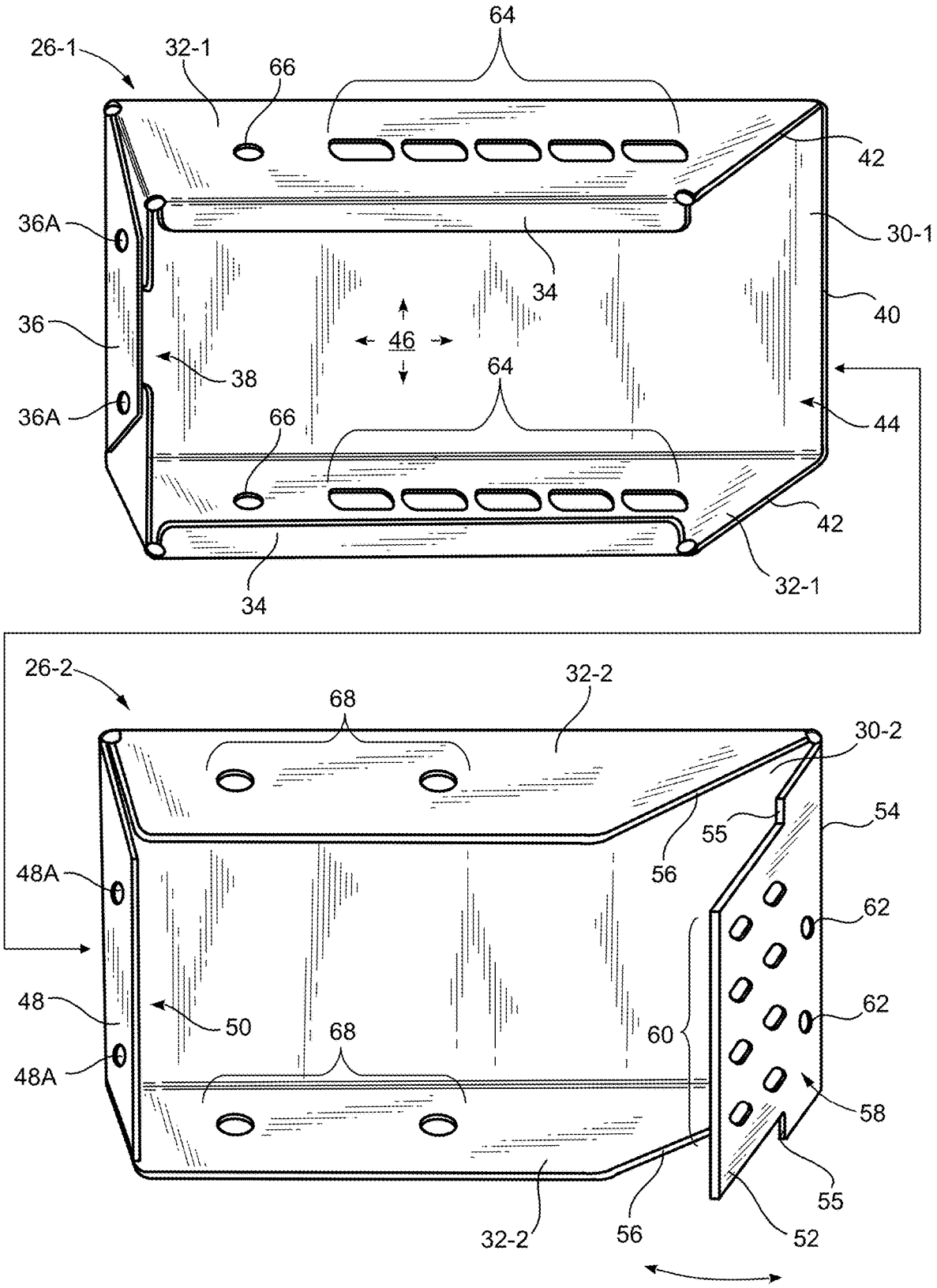
FIG. 7 is an enlarged perspective view showing a rear side of the first and second drop-in step components of FIG. 5 prior to being engaged in nested relationship.

The maximum nesting overlap distance between the second drop-in step components 26-2 and the first drop-in step components 26-1 of any given stair step 26 will typically be substantially the length of the second drop-in step components, provided the drop-in step components are configured to accommodate substantially 100% nesting overlap. Each of the embodiments disclosed herein have second drop-in step components 26-2 that provide this capability. For example, as can be seen in the embodiment of FIG. 7, the only structure preventing exactly 100% nesting overlap are the respective end flanges 36 and 48 of the first and second drop-in step components 26-1, 26-2. The combined thickness of these flanges will typically be quite small (e.g., not more than approximately 0.2 inches total for the case where 14 gauge steel is used as the sheet material for the embodiment of FIG. 7). It will be appreciated that the maximum nesting overlap condition of the first and second drop-in step components 26-1, 26-2 represents a minimum extension condition of the stair step 26. This minimum stair step extension condition is characterized by the width dimension of the stair step having its smallest possible value, namely, the width dimension corresponding to the combined length of all the first drop-in step components 26-1 in the stair step, plus the combined end flange thickness of each nested pair of first and second drop-in step components (assuming end flanges are present).

The minimum nesting overlap distance between the second drop-in step components 26-2 and the first drop-in step components 26-1 of any given stair step 26 will typically be whatever nested overlap distance is needed to allow these components to be fastened together (hereinafter referred to as the fastening overlap distance). The fastening overlap distance will typically be 1-2 inches minimum for each pair of first and second drop-in step components 26-1, 26-2 that are nested together. It will be appreciated that the minimum nesting overlap condition of the first and second drop-in step components 26-1, 26-2 represents a maximum extension condition of the stair step 26. This maximum stair step extension condition is characterized by the width dimension of the stair step having its largest possible value, namely, the width dimension corresponding to the combined length of all the first and second drop-in step components 26-1, 26-2 in the stair step, minus the total fastening overlap distance.

Each stair step 26 may be thought of as having an adjustment capability representing the difference between its minimum stair step extension condition and its maximum stair step extension condition, which is the collective maximum nesting overlap distance of all the second drop-in step components 26-2 in the step. Thus, the adjustment capability of any given stair step 26 will usually be the combined length of its second drop-in step components 26-2 minus the fastener overlap distance needed to secure each such second drop-in step component to an adjacent first drop-in step component 26-1. Providing second drop-in step components having a standardized length such as six inches, 12 inches, 16 inches, etc. thus provides significant customization capability during stair step installation.

In the illustrated embodiment of FIG. 3-4 wherein the first drop-in step components 26-1 are interior components and the second drop-in step components 26-2 are end components, the first drop-in step components 26-1 of each stair step 24 may be secured together end-to-end using any suitable attachment technique, such as sheet metal screws. The second drop-in step components 26-2 may be installed in nested relationship with the outermost first drop-in step components 26-1 and slidably adjusted to provide the desired amount of nesting overlap. The first and second drop-in step components 26-1, 26-2 may then be fastened together so as to be statically secured as integral parts of the stair step 24, and the second drop-in step components may be attached to the opposing sidewall panels 6A and 6C.

Figure 5:
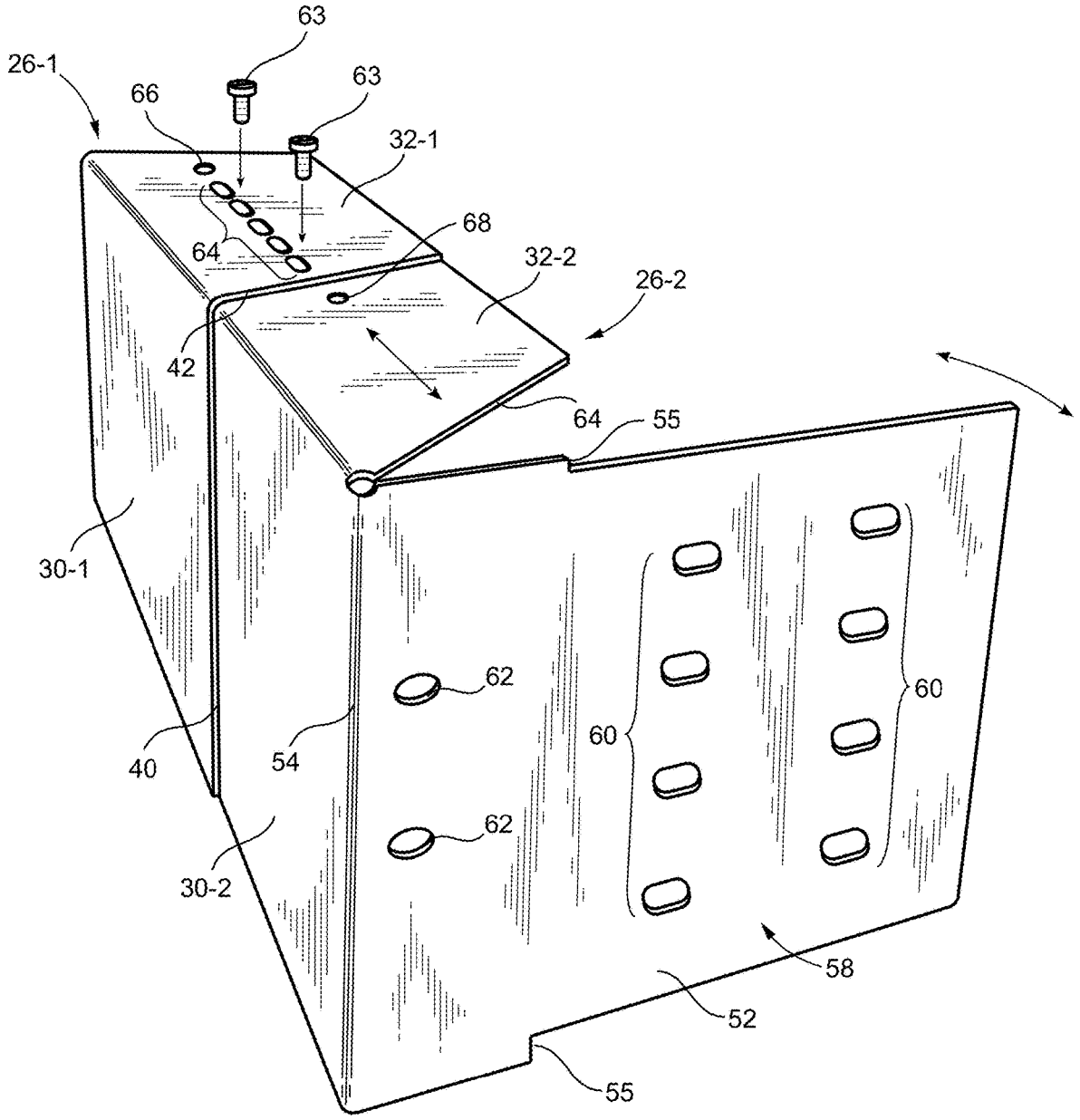
FIG. 5 is an enlarged perspective view showing a front side of first and second drop-in step components of the stair system of FIG. 1 engaged in nested relationship.
Figure 6:
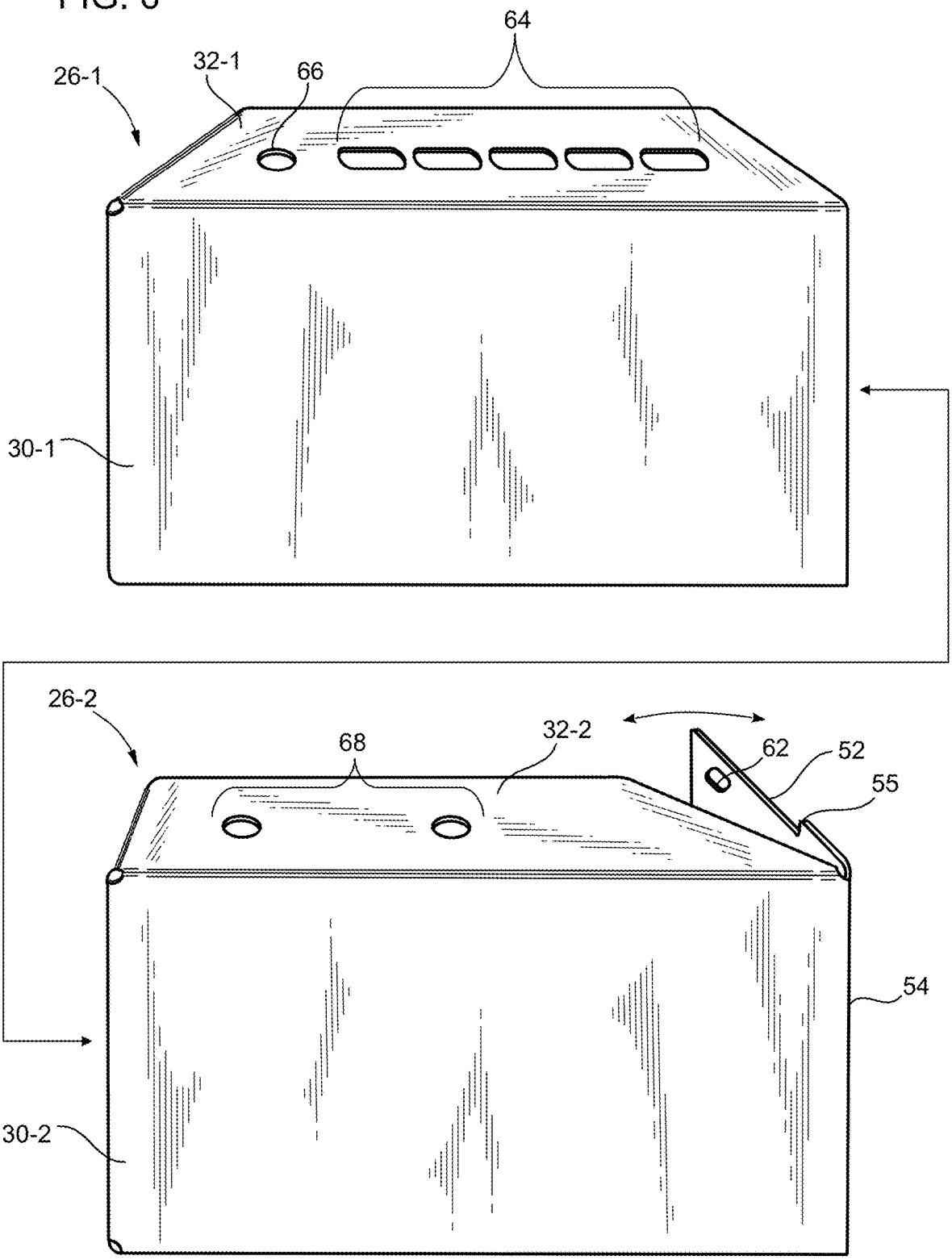
FIG. 6 is an enlarged perspective view showing a front side of the first and second drop-in step components of FIG. 5 prior to being engaged in nested relationship.

Turning now to FIGS. 5-7, an example nesting configuration is shown that allows for slidable adjustment and static securement of the second drop-in component 26-2 to the first drop-in step component 26-1. In this embodiment, which is shown for purposes of example only, the first and second drop-in step components 26-1, 26-2 are formed as interleaved U-shaped channel sections made from 14 gauge steel sheet material. As best shown in FIG. 7, the U-channel configuration of the first and second drop-in step components 26-1, 26-2 may be formed by respective vertical web sections and 30-2 and respective horizontal flange sections 32-1 and 32-2. The web sections 30-2 define the riser portion of the stair steps 24 and will vary in height according to which step is being installed. For example, assuming the steps 24-1, 24-2 and 24-3 have respective finished riser heights (including tread mud lips) of 10.5 inches, 10.75 inches and 10.75 inches, the web sections 30-1, 30-2 may be sized so that the drop-in step components 26-1, 26-2 have respective heights of 11.0 inches for the first step 24-1, 21.75 inches for the second step 24-2, and 32.5 inches for the third step 24-3. The flange sections 32-1, 32-2 provide structural stiffness and facilitate inter-attachment between the first and second drop-in step components 26-1, 26-2. The flange sections 32-1, 32-2 may be the same depth for each drop-in step component 26-1, 26-2, such as three inches, five inches, etc., in order to support the tread mud lips.

As can be seen in FIG. 7, the rear edges of the the flange sections 32-1 of the first drop-in step component 26-1 may be formed with vertical tabs 34. The vertical tabs 34 help maintain the second drop-in step component 26-2 in its nested relationship with the first drop-in step component 26-1 during installation of the stair system 20, such as by preventing the web section 30-2 from separating rearwardly away from the web section 30-1.

A vertical closed-end flange section 36 is shown at a closed end of the first drop-in step component 26-1 in FIG. 7. The closed-end flange section 36 may be formed by folding corresponding end portions of the web section 30-1 and the two flange sections 32-1. The closed-end flange section 36 allows the first drop-in component 26-1 to be attached to a corresponding end flange section of an adjacent first drop-in component (not shown in FIGS. 5-7) of the same stair step 24. One or more fastener-receiving openings 36A may be may be formed in the closed-end flange section 36 to facilitate such inter-attachment. The closed-end flange section 36 also defines a box-like closure 38 at the closed end of the first drop-in step component 26-1. The box-like closure 38 limits the slidable movement of the second drop-in step component 26-2 within the first drop-in step component 26-1.

The other end of the first drop-in component 26-1 in FIG. 7 is open-ended in order to receive the second drop-in step component 26-2 in slidable nested engagement. This open end of the first drop-in component 26-1 is defined by an open-end edge 40 of the web section 30-1 and a pair of open-end edges 42 of the flange sections 32-1. Advantageously, the open-end edges 42 of the flange sections 32-1 may be tapered so as to angle longitudinally away from the open-end edge 40 of the web section 30-1. This defines a scoop-shaped leading edge 44 of the first drop-in step component 26-1 that facilitates initial insertion of the second drop-in step component 26-2 into nested engagement with the first drop-in step component.

The area between the open-end leading edge 44 and the closed-end closure 38 of the first drop-in step component provides a U-shaped trough 46 for receiving the second drop-in step component 26-2 in nested engagement therewith. The trough 46 allows the second drop-in component 26-2 to freely slidably adjust relative to the first drop-in step component 26-1 in order to provide a desired amount of nesting overlap between these two components.

A closed end of the second drop-in step component 26-2 may be formed with a vertical closed-end flange section 48. The end flange section 48 may be formed by folding a corresponding end portion of the web section 30-2. Although not shown, the flange sections 32-2 of the second drop-in component 26-2 could also be folded to form part of the closed-end flange section 48. One or more fastener-receiving openings 48A may be may be formed in the closed-end flange section 48 to facilitate inter-attachment between the second drop-in component 26-1 and the first drop-in component 26-1. The closed-end flange section 48 also defines a box-like closure 50 at the closed end of the second drop-in step component 26-2.

With continuing reference to FIG. 7, and as also shown in FIGS. 5-6, the other end of the second drop-in step component 26-2 may be formed with an angled vertical anchor flange 52 for attachment to one of the opposing sidewall panels 6A and 6B of the swimming pool 2. The anchor flange 52 may formed as an extension of a corresponding end of the web section 30-2 by bending the web section to form a vertical end corner 54 of the web section. The anchor flange 52 is preferably adjustably bendable so that it can be manipulated during installation of the stair system 20 in order to conform to the precise angular orientation of the opposing sidewall panel 6A or 6B to which it attaches. As will be appreciated, the angular orientation of the sidewall panels 6A and 6B may be different in different regions of the pool 2 (see FIGS. 3-4), and may likewise vary from pool to pool. As shown in FIG. 7, optional cutouts 55 may be formed in the top and bottom edges of anchor flange 52 to reduce the height of the anchor flange and thereby facilitate unimpeded bending adjustment thereof.

In most installations, it should be be possible to attach the second drop-in step component 26-1 to its adjacent sidewall panel 6A or 6B with the anchor flange 52 being in the planar sheet configuration shown in FIGS. 5-7. However, the sidewall panel 6A or 6B may have enough localized curvature over the span of the anchor flange 52 to prevent the flange from lying flush against the sidewall panel. To accommodate such situations, the anchor flange 52 can be flexibly manipulated into conformity with the sidewall panel 6A or 6B curvature during stair system installation. Thus, the anchor flange 52 may be both angularly adjustable and flexible out-of-plane.

To accommodate the angular sweep of the anchor flange 52, the flange sections 32-2 of the second drop-in step component 26-2 may be formed with tapered edges 56 that angle longitudinally away from the vertical end corner 54 of the web section 30-2. The taper angle of the tapered edges 56 should be equal to or greater than the largest contemplated bending angle of the anchor flange 52.

To facilitate attachment to one of the sidewall panels 6A or 6B, the anchor flange 52 may be formed with one or more fastener-receiving openings 58. For example, one or more sets of fastener-receiving slots 60 may be provided for adjustable positioning during installation. In addition, or alternatively, one or more fastener-receiving holes 62 may be provided for secure permanent attachment of the drop-in step component 26-2 is in its final installation position. The first and second drop-in step components 26-1, 26-2 may be secured together by one or more fasteners. For example, FIG. 5 depicts two fasteners 63 that attach the upper flange section 32-1 of the first drop-in step component to the upper flange section 32-2 of the second drop-in step component. The lower flange sections 32-1, 32-2 of the first and second drop-in step component 26-1, 26-2 may be similarly joined. The fasteners 63 may be implemented as bolts, screws, rivets, or other suitable connectors. In an embodiment, one or both of the first and second drop-in step components 26-1, 26-2 may be formed with at least one set of prefabricated fastener-receiving openings to accommodate the fasteners 63. For example, the flange sections 32-1 of the first drop-in step component 26-1 may have one or more prefabricated fastener-receiving openings 64 and 66 that are shown in FIGS. 5-7 as a row of slots (64) and a single hole (66). The flange sections 32-2 of the second drop-in step component 26-2 may be formed with one or more prefabricated fastener-receiving openings 68 that are shown in FIGS. 5-7 as a row of holes.

As can be seen in FIG. 5, providing some or all of the fastener-receiver openings as a set of fastener-receiving slots facilitates infinitesimally incremental adjustment of the nesting overlap between the first and second drop-in step components 26-1, 26-2. In this embodiment, the row of fastener-receiving slots 64 and the fastener-receiving hole 66 in the flanges 32-1 of the first drop-in step component 26-1 are longitudinally aligned with the row of fastener-receiving holes 68 in the flanges 32-2 of the second drop-in step component 26-2. By properly selecting the size and spacing of the fastener-receiving slots 64, together with the size and spacing of the fastener-receiving holes 66 and 68, there will always be at least one fastener-receiving slot aligned with at least one fastener-receiving hole to receive the fasteners 63 at all nesting overlap positions of the first and second drop-in step components 26-1, 26-2. Insofar as the amount of nesting overlap can be infinitesimally varied, the defined width dimension of the corresponding stair step 24 may be continuously adjusted, allowing the stair step to be precisely fitted between (and attached to) the opposing sidewall panels 6A and 6B.

Figure 5A:
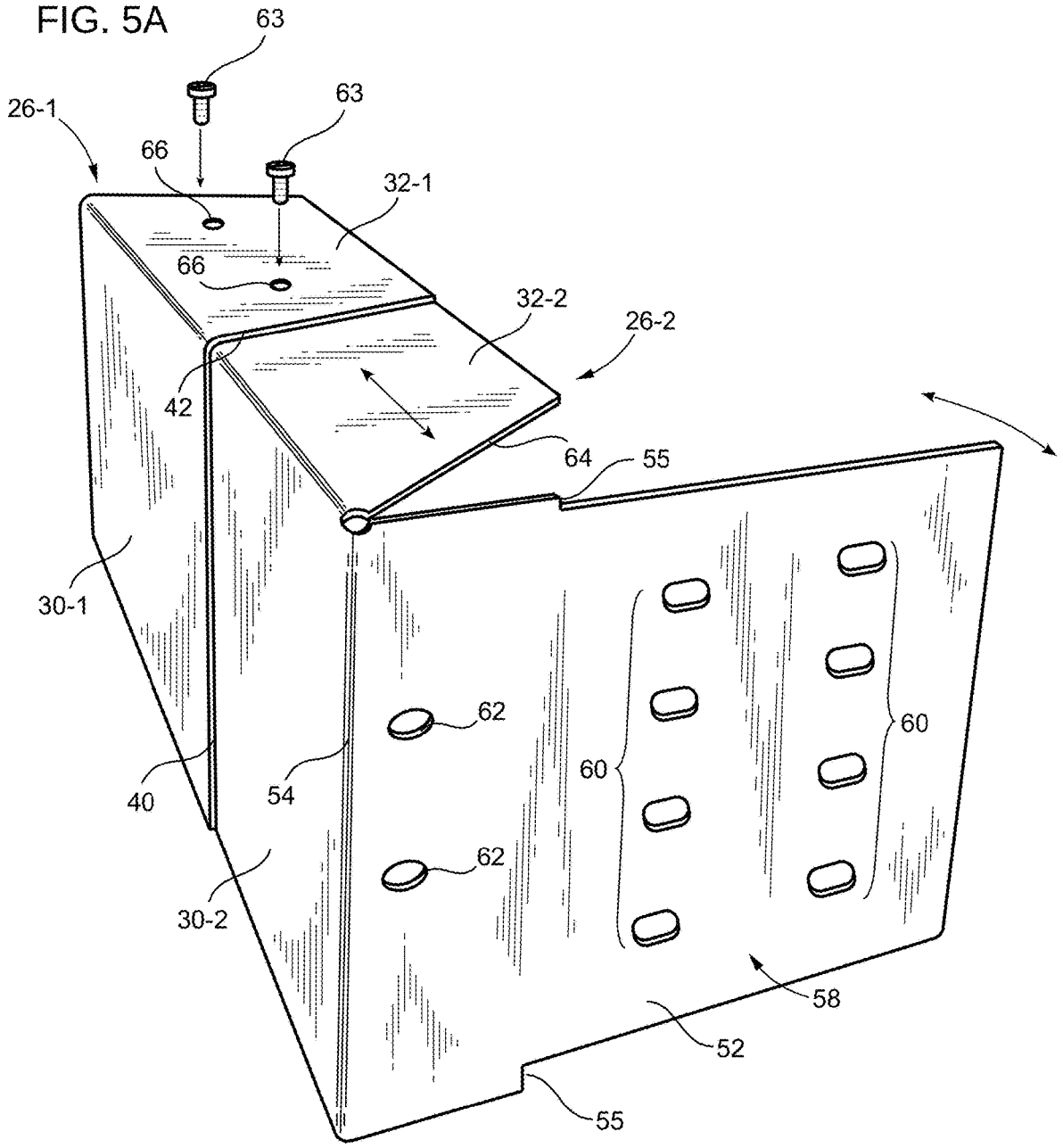
FIG. 5A is an enlarged perspective view showing a front side of first and second drop-in step components of the stair system of FIG. 1 engaged in nested relationship according to an alternate embodiment.
Figure 5B:
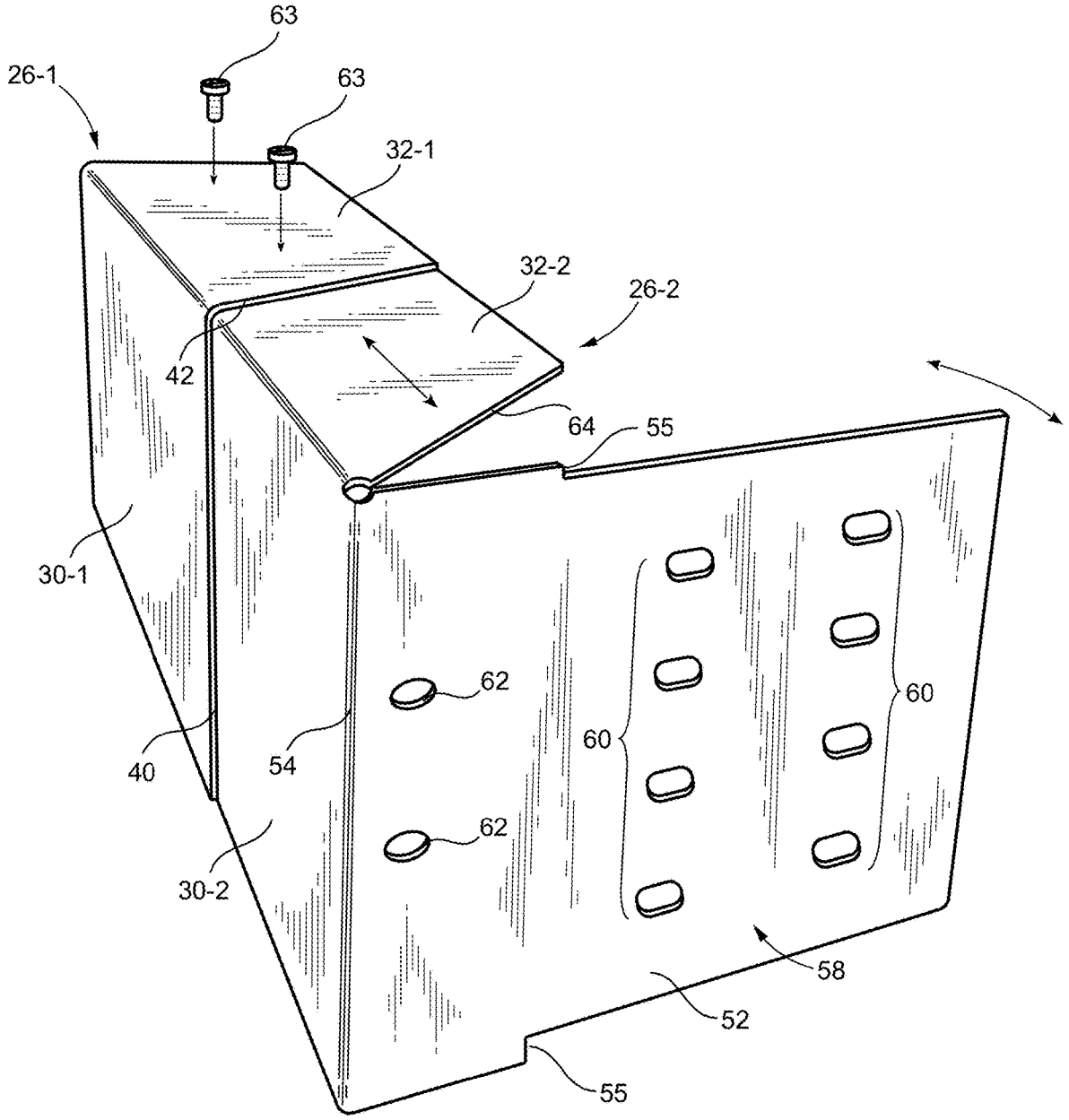
FIG. 5B is an enlarged perspective view showing a front side of first and second drop-in step components of the stair system of FIG. 1 engaged in nested relationship according to another alternate embodiment.

It will of course be appreciated that the first and second drop-in step components 26-1, 26-2 could be formed without prefabricated fastener-receiving openings in the second drop-in-step component or perhaps in neither drop-in step component. The former option is shown in FIG. 5A, with the first drop-in step component 26-1 having two pre-fabricated fastener receiving openings 66 (formed as holes), but with the second drop-in step component 26-2 having no fastener-receiving openings. In that case, the first and second drop-in components 26-1, 26-2 can be slidably adjusted to a desired nesting position and secured together by fastening at the locations defined by the fastener-receiving openings 66. The latter option is shown in FIG. 5B, with neither the first drop-in step component 26-1 nor the second drop-in step component 26-2 having prefabricated fastener receiving openings. In both embodiments, the fasteners 63 may be implemented as self-tapping screws or the like. This may be more time consuming than using prefabricated fastener-receiving openings, but has the advantage of allowing custom fitting in the event that the first and second drop-in step components need to be manipulated (e.g., angularly up/down or forward/backward) (in order to achieve a proper fit) to such an extent that pre-fabricated fastener-receiving openings would no longer line up.

Figure 8:
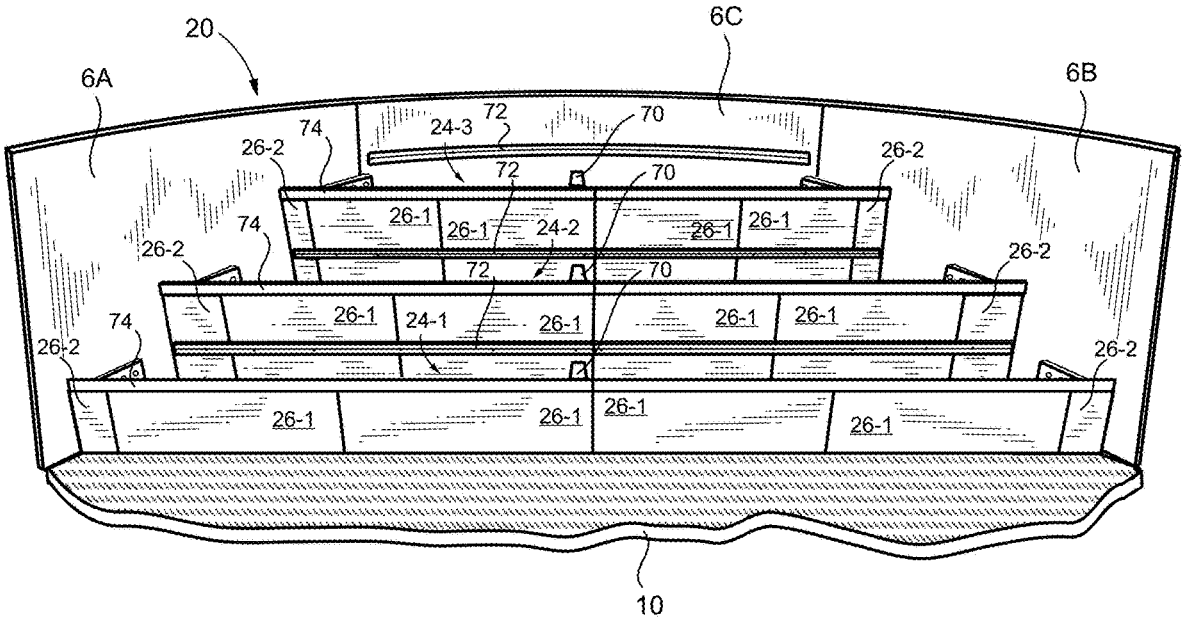
FIG. 8 is a perspective view showing the stair system of FIG. 1 in a further a further stage of stair system assembly that precedes the introduction of backfill material between the stair steps formed by the first and second step components in order to form stair treads.
Figure 9:
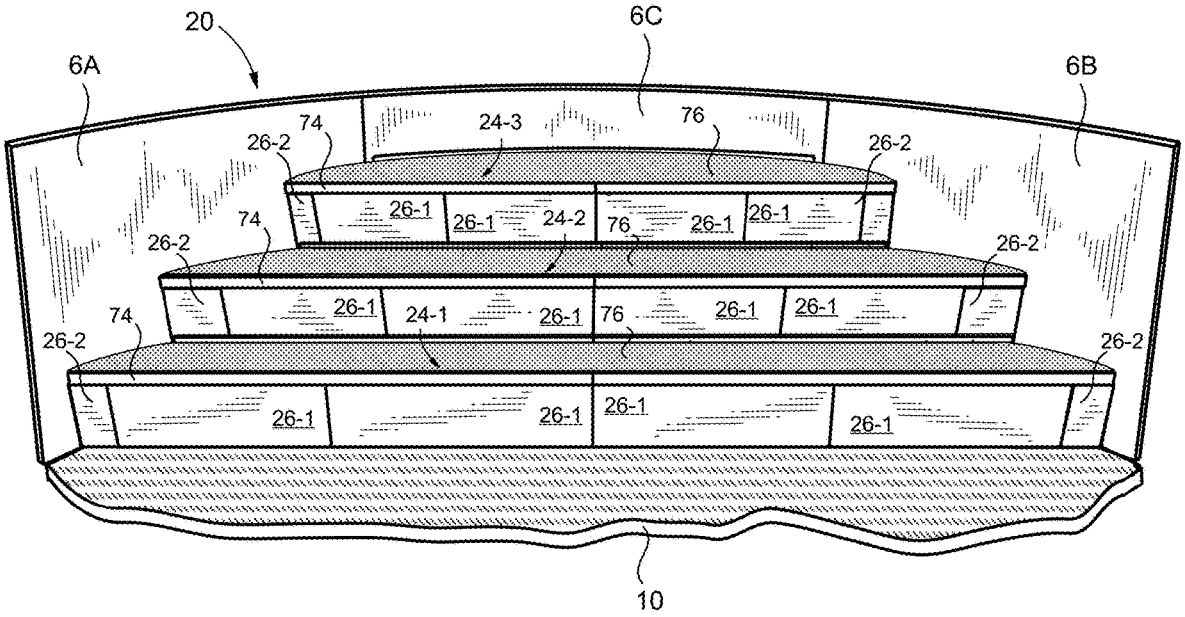
FIG. 9 is a perspective view showing the stair system of FIG. 1 in a further a further stage of stair system assembly that follows the introduction of backfill material between the stair steps formed by the first and second step components in order to form stair treads.
Figure 10:
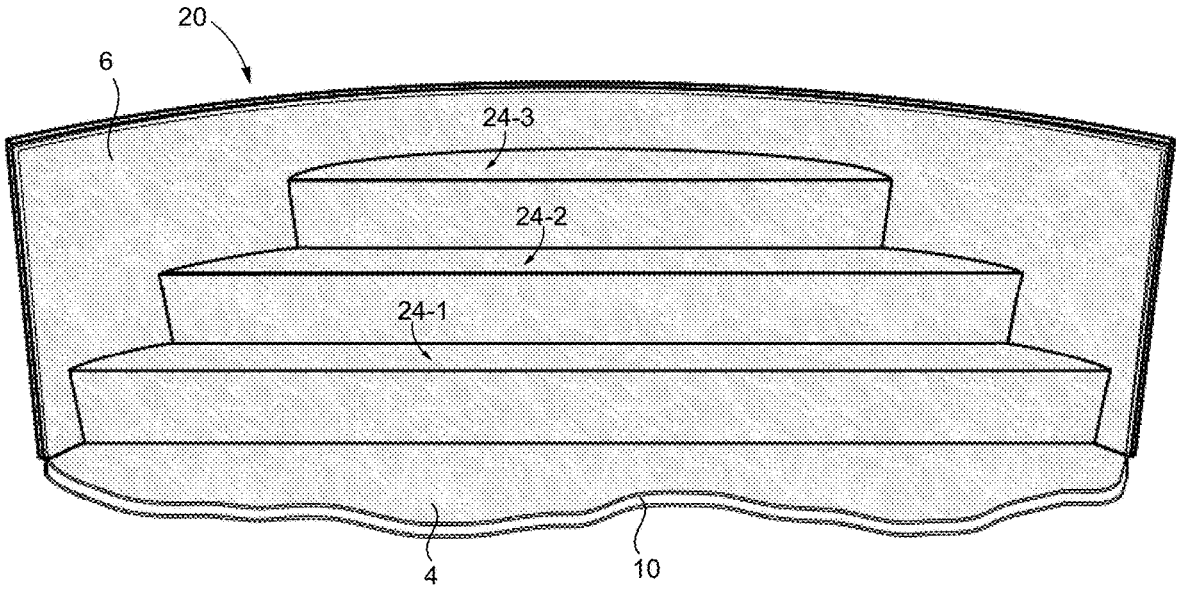
FIG. 10 is a perspective view showing the stair system of FIG. 1 in a further a further stage of stair system assembly that follows the installation of a vinyl liner over the stair steps formed by the first and second step components.

Turning now to FIGS. 8-10, FIG. 8 depicts the stair system 20 following installation and attachment of the stair steps 24 to the sidewall panels 6A and 6B. A set of brackets 70 has been installed between each stair stair step 24 to provide structural rigidity. A set of liner bead-receiver tracks 72 has been attached to the front face of each stair step 24, and to the sidewall panel 6C. The liner bead-receiver tracks 72 are used to secure inside-corner stair step portions the liner 4 to the stair steps 24. A set of tread mud-lip members 74 has been attached to the top of each stair step 24. The tread mud lip members 74 serve as forms that will define the tread mud lips at the front edges of stair system's open pour treads.

When the stair system 20 is embodied as a kit that includes the first and second drop-in step components 26-1, 26-2 in disassembled form, the bead-receiver tracks 72 and the tread mud lip members 74 may be both be included as part of the kit. For example, one bead-receiver track 72 and one tread mud lip member 74 may be provided for each step 26, and each may have a length that is equal to the combined length of the first and second drop-in step components 26-1, 26-2 of that step. Any excess length resulting from the nesting overlap between the drop-in step components 26-1, 26-2 may be dealt with by trimming the bead-receiver tracks 72 and the tread mud lip members 74 as necessary.

FIG. 9 depicts the stair system 20 following the formation of open pour treads 76. As previously mentioned, this may be accomplished by back-filling the spaces between the stair step risers (formed by the first and second drop-in step components 26-1, 26-2) with a suitable filler material, such as gravel, that is surfaced with a cap made of a sand/cement/vermiculite mixture.

FIG. 10 depicts the stair system 20 following installation of the liner 4 such that each of the three stair steps 24-1, 24-2 and 24-3 is fully vinyl-covered, as is the pool sidewall 6.

Figure 11:
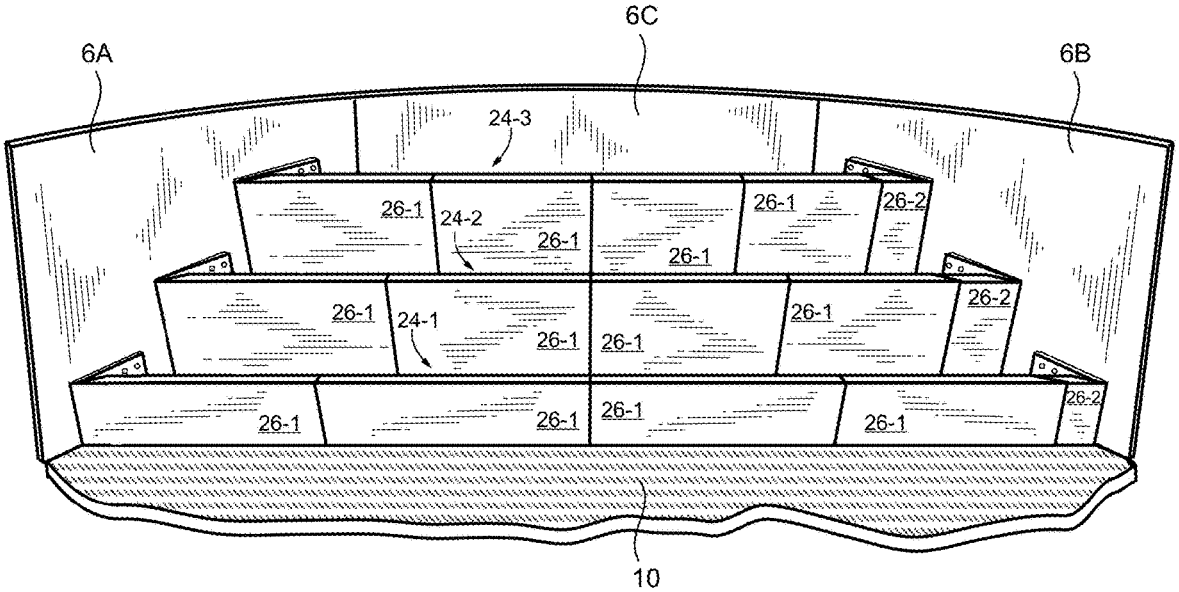
FIG. 11 is a perspective view showing the stair system of FIG. 1 according to an another embodiment that uses an alternative arrangement of first and second drop-in step components.

It should be understood that various modifications may be made to the stair system 20 without departing from the spirit of the present disclosure. For example, as shown in FIG. 11, instead of using two second drop-in step components 26-2 arranged on each side of the stair steps 24, only a single second drop-in step component might be provided on one side of each step (or optionally on only some of the stair steps). The other side of the stair step 24 could be provided by a first drop-in step component 26-1 that is suitably fastened to one of the sidewall panels 6A or 6B. In FIG. 11, the single second drop-in step component 26-2 is shown on the right side of each step 24, and is attached to the sidewall panel 6B. The first drop-in step components 26-1 that form the remainder of each step 24 extend from the second drop-in component 26-2 to the left side of the step, and the left-most one of the first drop-in step components is attached to the sidewall panel 6A.

Figure 12:
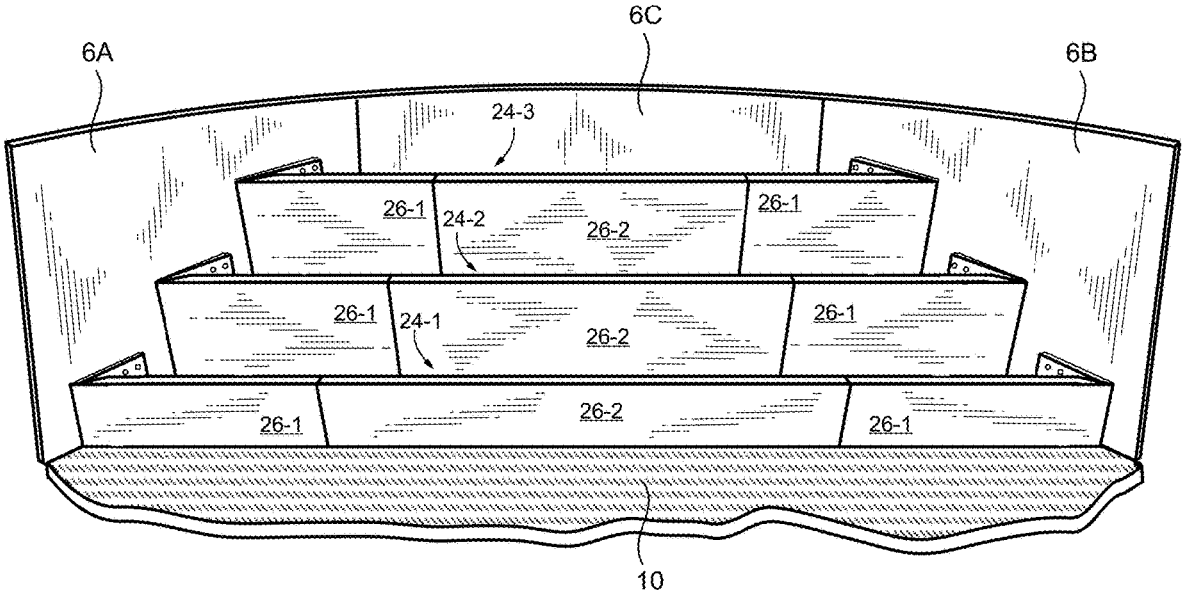
FIG. 12 is a perspective view showing the stair system of FIG. 1 according to a further embodiment that uses another alternative arrangement of first and second drop-in step components.

Alternatively, as shown in FIG. 12, a single drop-in step component 26-2 could be provided that installs at an interior location of the stair steps 24 (or optionally on only some of the stair steps), between two adjacent first drop-in step components 26-1. The second drop-in step component 26-2 could nest within each of the adjacent first drop-in step components 26-1. The adjacent first drop-in step components 26-1, or other first drop-in step components connected thereto, could be suitably attached to the opposing sidewall panels 6A and 6B. In FIG. 12, there is a single second drop-in step component 26-2 situated at the center of each stair step, in nested engagement with a pair of first drop-in step components 26-1. The first drop-in step component 26 on the left attaches to the sidewall panel 6A. The first drop-in step component 26 on the right attaches to the sidewall panel 6B.

Accordingly, a width-adjustable drop-in stair system for an in-ground vinyl liner swimming pool, together with a related stair system kit and stair system installation method, have been disclosed.

As used in this application, the terms such as "side," "end", "upper," "lower," "top," "bottom," "vertical," "vertically," "lateral," "laterally," "inner," "outer," "outward," "inward," "front," "frontward," "forward," "rear," "rearward," "back," "backward," "upwardly," "downwardly," "inside," "outside," "interior," "exterior," and other orientational descriptors are intended to facilitate the description of the example embodiments of the present disclosure, and are not intended to limit the structure of the example embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments. Terms of rough approximation, such as "generally," are understood by those of ordinary skill to refer to a characteristic or feature of that bears resemblance to something, such that it is reasonable to draw a comparison to facilitate understanding, without requiring that the characteristic or feature be exactly the same, or even substantially the same, as the thing to which it is compared.

For purposes of explanation, specific configurations and details have been set forth herein in order to provide a thorough understanding of the present invention. However, it will be apparent to one of ordinary skill in the art that embodiments of the present invention may be practiced without the specific details presented herein. Furthermore, well-known features may have been omitted or simplified in order not to obscure the present invention. Various examples may be given throughout this description. These examples are merely descriptions of specific embodiments of the invention. The scope of the invention is not limited to the examples given.

Reference in the present disclosure to an "embodiment" means that a particular feature, structure or characteristic described in connection with the embodiment may be included in at least one embodiment of the disclosed apparatus. Thus, the appearances of the term "embodiment" in various places throughout the specification are not necessarily all referring to the same embodiment.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

It is understood, therefore, that the invention is not to be in any way limited except in accordance with the scope of the appended claims and their equivalents.

What is claimed is:

1. A width-adjustable drop-in stair system for an in-ground vinyl liner swimming pool, comprising:

a first drop-in step component having a first length;

a second drop-in step component that is independent of the first drop-in step component, the second drop-in step component having a second length;

the first and second drop-in step components being arranged as parts of a stair step that attaches to opposing sidewall panels of the swimming pool;

the second drop-in step component is engaged in partial nested relationship with the first drop-in step component at a nesting overlap distance that is established to configure the stair step with a defined width dimension corresponding to a distance between the opposing sidewall panels at locations where the stair step is attached;

the defined width dimension being less than the first length and the second length in total; and the first and second drop-in step components being fastened together so as to be statically secured as parts of the stair step.

2. The stair system of claim 1, wherein the one or both of the first and second drop-in step components are formed with at least one prefabricated fastener-receiving opening.

3. The stair system of claim 1, wherein one or both of the first and second drop-in step components are formed with prefabricated fastener-receiving slots to facilitate continuous adjustment of the defined width dimension.

4. The stair system of claim 1, wherein the stair system comprises an open-pour vinyl-over-steel stair system, and wherein the first and second drop-in step components are arranged to define parts of a stair riser that serves as a form for back-filling materials that form a stair tread.

5. The stair system of claim 1, wherein the first drop-in step component is situated at an interior portion of the stair step, and wherein the second drop-in step component is situated at a side portion of the stair step and attaches to one of the opposing sidewall panels of the swimming pool.

6. The stair system of claim 1, wherein the first drop-in step component is situated at an interior portion of the stair step, and wherein there are two second drop-in step components respectively situated at opposite side portions of the stair step that attach to the opposing sidewall panels of the swimming pool.

7. The stair system of claim 1, wherein there are at least two first drop-in step components situated at an interior portion of the stair step, and wherein there are two second drop-in step components respectively situated at opposite side portions of the stair step that attach to the opposing sidewall panels of the swimming pool.

8. The stair system of claim 1, wherein there are at least two first drop-in step components, and wherein the second drop-in step component is situated at an interior portion of the stair step between the at least two first drop-in step components.

9. The stair system of claim 8, wherein the second drop-in component comprises an angled flange for attachment to one of the opposing sidewall panels of the swimming pool, the angled flange being adjustably bendable so as to conform to an angular orientation of the opposing sidewall panel to which it attaches.

10. The stair system of claim 9, wherein the angled flange is formed with one or more prefabricated fastener-receiving openings.

11. The kit of claim 1, wherein the first drop-in step component is configured to be situated at an interior portion of the stair step, and wherein the second drop-in step component is configured to be situated at a side portion of the stair step for attachment to one of the opposing sidewall panels of the swimming pool.

12. A kit for fabricating a width-adjustable drop-in stair system for an in-ground vinyl liner swimming pool, comprising:

a first drop-in step component having a first length;

a second drop-in step component that is independent of the first drop-in step component, the second drop-in step component having a second length;

the first and second drop-in step components being arrangeable as parts of a stair step that can be attached to opposing sidewall panels of the swimming pool;

the second drop-in step component being configured to engage in nested relationship with the first drop-in step component at a nesting overlap distance that is established to configure the stair step with a defined width dimension corresponding to a distance between the opposing sidewall panels at locations where the stair step is to be attached;

the defined width dimension being less than the first length and the second length in total; and the first and second drop-in step components being configured for fastening together so as to be statically secured as parts of the stair step.

13. The kit of claim 12, wherein the one or both of the first and second drop-in step components are formed with at least one prefabricated fastener-receiving opening.

14. The kit of claim 12, wherein one or both of the first and second drop-in step components are formed with prefabricated fastener-receiving slots to facilitate substantially continuous adjustment of the defined width dimension.

15. The kit of claim 12, wherein the stair system comprises an open-pour vinyl-over-steel stair system, and wherein first and second drop-in step components are arrangeable to define a stair riser that serves as a form for back-filling materials that form a stair tread.

16. The kit of claim 12, wherein the first drop-in step component is configured to be situated at an interior portion of the stair step, and wherein there are two second drop-in step components configured to be situated at opposite side portions of the stair step for attachment to the opposing sidewall panels of the swimming pool.

17. The kit of claim 12, wherein there are at least two first drop-in step components configured to be situated at an interior portion of the stair step, and wherein there are two second drop-in step components respectively configured to be situated at opposite side portions of the stair step for attachment to the opposing sidewall panels of the swimming pool.

18. The kit of claim 12, wherein there are at least two first drop-in step components, and wherein the second drop-in step component is configured to be situated at an interior portion of the stair step between the at least two first drop-in step components.

19. The kit of claim 12, wherein the second drop-in component comprises an angled flange for attachment to one of the opposing sidewall panels of the swimming pool, the angled flange being adjustably bendable so as to conform to an angular orientation of the opposing sidewall panel to which it attaches.

20. The kit of claim 19, wherein the angled flange is formed with one or more prefabricated fastener-receiving openings.

21. A method for fabricating a width-adjustable drop-in stair system for an in-ground vinyl liner swimming pool, comprising:

providing a first drop-in step component having a first length;

providing a second drop-in step component that is independent of the first drop-in step component, the second drop-in step component having a second length;

forming an arrangement of the first and second drop-in step components as parts of a stair step that can be attached to opposing sidewall panels of the swimming pool;

the arrangement including the second drop-in step component being in nested relationship with the first drop-in step component at a nesting overlap distance that is established to configure the stair step with a defined width dimension corresponding to a distance between the opposing sidewall panels at locations where the stair step is to be attached;

the defined width dimension being less than the first length and the second length in total;

fastening together the first and second drop-in step components so as to be statically secured as parts of the stair step; and fastening the stair step to the opposing sidewalls of the swimming pool.

* * * * *